US006637137B2

(12) United States Patent
Coster et al.

(10) Patent No.: US 6,637,137 B2
(45) Date of Patent: Oct. 28, 2003

(54) GESTATION CALENDAR

(76) Inventors: Lisha Coster, 147 Pineridge Dr., Hopewell Junction, NY (US) 12533; Kathleen Horgan, 445 Broadway, Hastings on Hudson, NY (US) 10706-2314; Patty Mahoney, 138 Mountain Rd., Pleasant Valley, NY (US) 12569; Shiela Townsend, 70 Barber St., Mt Kisco, NY (US) 10549

( * ) Notice: Subject to any disclaimer, the term of this patent is extended or adjusted under 35 U.S.C. 154(b) by 0 days.

(21) Appl. No.: 10/105,500

(22) Filed: Mar. 25, 2002

(65) Prior Publication Data

US 2003/0182826 A1 Oct. 2, 2003

(51) Int. Cl.[7] ..... G09D 3/08
(52) U.S. Cl. ..... 40/113; 40/115
(58) Field of Search ..... 40/111, 113, 114, 40/115, 595

(56) References Cited

U.S. PATENT DOCUMENTS

| | | | |
|---|---|---|---|
| 2,118,354 | A | 5/1938 | Mansur |
| 2,244,514 | A | 6/1941 | Cwiekalo |
| 3,278,118 | A | 10/1966 | Klein, Jr. |
| 3,279,696 | A | 10/1966 | Sherman |
| 4,133,476 | A | 1/1979 | Poage et al. |
| 4,625,099 | A | 11/1986 | Freedom |
| 4,737,619 | A | 4/1988 | Freedom et al. |
| 5,443,288 | A | 8/1995 | Miles |
| 5,763,860 | A | 6/1998 | Denis et al. |

OTHER PUBLICATIONS

Corometrics Medical Systems, Pregnancy Wheel (1983).

*Primary Examiner*—Gary Hoge
(74) *Attorney, Agent, or Firm*—Law Office of Leo Zucker

(57) ABSTRACT

A gestation calendar for use by an expectant mother. A first disk has first indicia corresponding to days of a calendar year. A second disk is pivoted concentrically to the first disk and has second indicia defining successive weeks of a gestation term and associated information. The information includes imagined statements by a fetus representing its development during the time intervals, with corresponding information relating to prenatal health care for the mother. When the first and the second disks are positioned so that an index mark of the second indicia is aligned with a start date of the mother's last period in the first indicia, the development of the fetus at a certain date during pregnancy along with the corresponding prenatal health care information are conveyed by the information associated with that time interval which is aligned with the certain date in the first indicia.

5 Claims, 4 Drawing Sheets

14
12
16
18
22
28
32
26
24
10
April
May
June
July
August
September
October
November
December
January
February
March
MY HEART...
I'M BORN LIKE...
I CAN MOVE...
I'M BORN LIKE...
I'M BORN LIKE...
I'M BORN LIK

GESTATION CALENDAR

BACKGROUND OF THE INVENTION

1. Field of The Invention

This invention relates to calendar devices.

2. Discussion of The Known Art

A pregnancy "wheel" calendar available from Corometrics® Medical Systems Inc., North Wallingford, Conn., includes a rear disk with indicia along its circumference corresponding to months and days of a year; and a smaller, concentric front disk having a number of sectors corresponding to the weeks of a human gestation term. Certain numeric data is printed within the sectors to indicate a fetus's expected weight and length at the corresponding week.

U.S. Pat. No. 5,443,288 (Aug. 22, 1995) relates to a pregnancy advent calendar for informing a user of milestones of the fetal development process. The calendar includes an upper paper layer and a substrate paper layer. Rectangular tabs are cut in the upper layer to swing outward, and the tabs are labeled with numbers corresponding to the weeks of the gestation term. When a tab for a given week is lifted, a "message" from the fetus can be read.

U.S. Pat. No. 5,763,860 (Jun. 9, 1998) discloses a gestational calculator to fit in the pocket of a user. The calculator computes an expected due date based on an initial date corresponding to the first day of the expectant mother's last period. The calculator may also determine a gestational age based on the initial and the current dates, according to the patent.

There remains a need, however, for a calendar that allows an expectant mother to be informed concerning the state of development of the fetus at a desired date during pregnancy, together with any important prenatal health care measures to be taken by the mother on or around the desired date.

SUMMARY OF THE INVENTION

According to the invention, a gestation calendar for use by an expectant mother includes a first sheet material having first indicia corresponding to days of a calendar year. A second sheet material is mounted to the first sheet material for relative movement and has second indicia defining successive time intervals of a gestation term of a fetus and information associated with each of the time intervals.

The information includes imagined statements by the fetus representing its development during the time intervals defined by the second indicia, with corresponding information concerning prenatal health care for the mother. When the second sheet material is positioned to align an index mark of the second indicia with a start date of the expectant mother's last period in the first indicia, the state of development of the fetus at a certain date during the gestation term together with corresponding prenatal health care measures for the mother are conveyed by the information associated with that time interval which is aligned with the certain date in the first indicia.

For a better understanding of the invention, reference is made to the following description taken in conjunction with the accompanying drawing, and the scope of the invention will be pointed out by the appended claims.

DETAILED DESCRIPTION OF THE INVENTION

Figure 1:
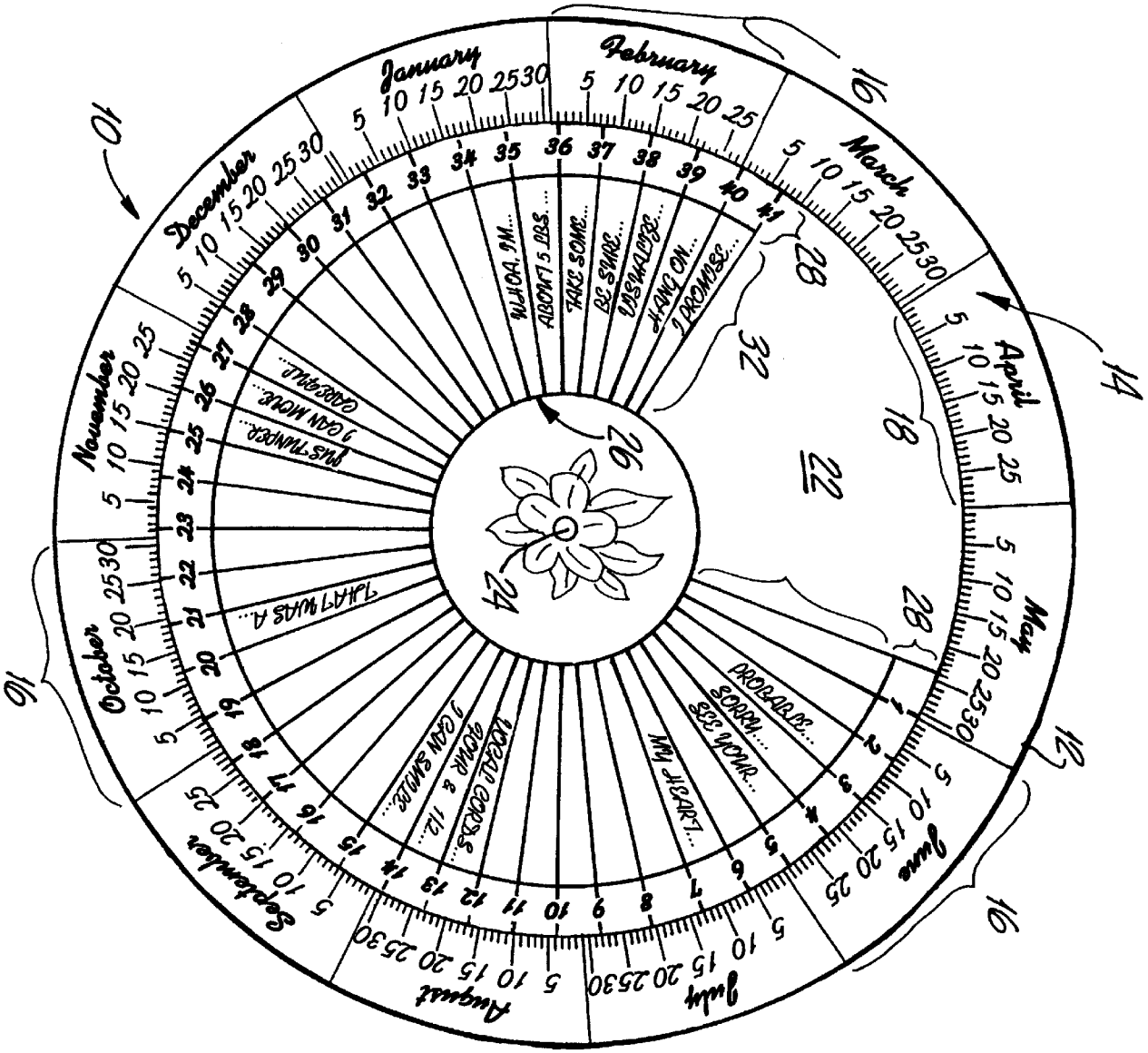
FIG. 1 is a view of a gestation calendar according to the invention, as seen from the front.

FIG. 1 shows a gestation calender 10 according to the invention. Basically, the calendar 10 comprises a first piece of rigid sheet material or board 12, e.g., paper cardboard or other suitable planar medium on which text and other indicia may be printed or displayed. In the present embodiment, the first board. 12 is formed as a circular disk on which first indicia 14 are printed over a portion of the first board in the region of the outer periphery or circumference of the board 12. The first indicia correspond to the days of a calender year, and each of the twelve months of the year are labeled within corresponding sectors 16 which subtend arcs of substantially the same length about the circumference of the first board 12. Within each of the month-sectors 16, the days of a particular month are represented by scale marks 18 which are numbered, for example, every five days of the particular month.

The calendar 10 also includes a second piece of rigid sheet material or board 22 made from paper cardboard or equivalent planar medium on which text and other indicia may be printed or displayed. In the disclosed embodiment, the second board 22 is also in the form of a circular disk having a diameter less than that of the first board 12. The second board 22 is mounted to the first board for rotational movement with respect to the first board. For example, the second board 22 is pivoted at its center concentrically to the first board 12 by a conventional fastening member 24 that passes through the centers of both of the boards 12, 22.

The second board 22 has second indicia 26 over a portion of the board 22 that subtends an arc corresponding to the ratio of a human gestation term of, e.g., forty-one weeks to a total fifty-two weeks of a year. In the disclosed embodiment, the second indicia 26 define the forty-one successive weeks by correspondingly numbered week-scale marks 28 that extend radially through a portion of the circumference of the second board 22. The first indicia 14 on the first board 12, and the second indicia 26 on the second board 22, are dimensioned and arranged so that when the second board 22 is rotated relative to the first board 12, an index mark 30 at a beginning of the second indicia can be aligned with a date within the first indicia 14 which date is the start date of an expectant mother's last period. In the illustrated embodiment, the index mark 30 is aligned with the date May 24.

The second indicia 26 also define, between the week-scale marks 28 and the center of the board 22, a number of sectors 32 corresponding to each of the weeks numbered by the marks 28. Text of imagined statements by the fetus representing its state of development during each time interval (week) defined by the second indicia, are printed within the sectors 32. Some statements are partially shown within the sectors 32 in FIG. 1, and a full set of such statements are given in the table further below. At least some of the text relates to important prenatal e measures to be taken by the expectant mother on or corresponding time intervals during pregnancy.

Figure 2:
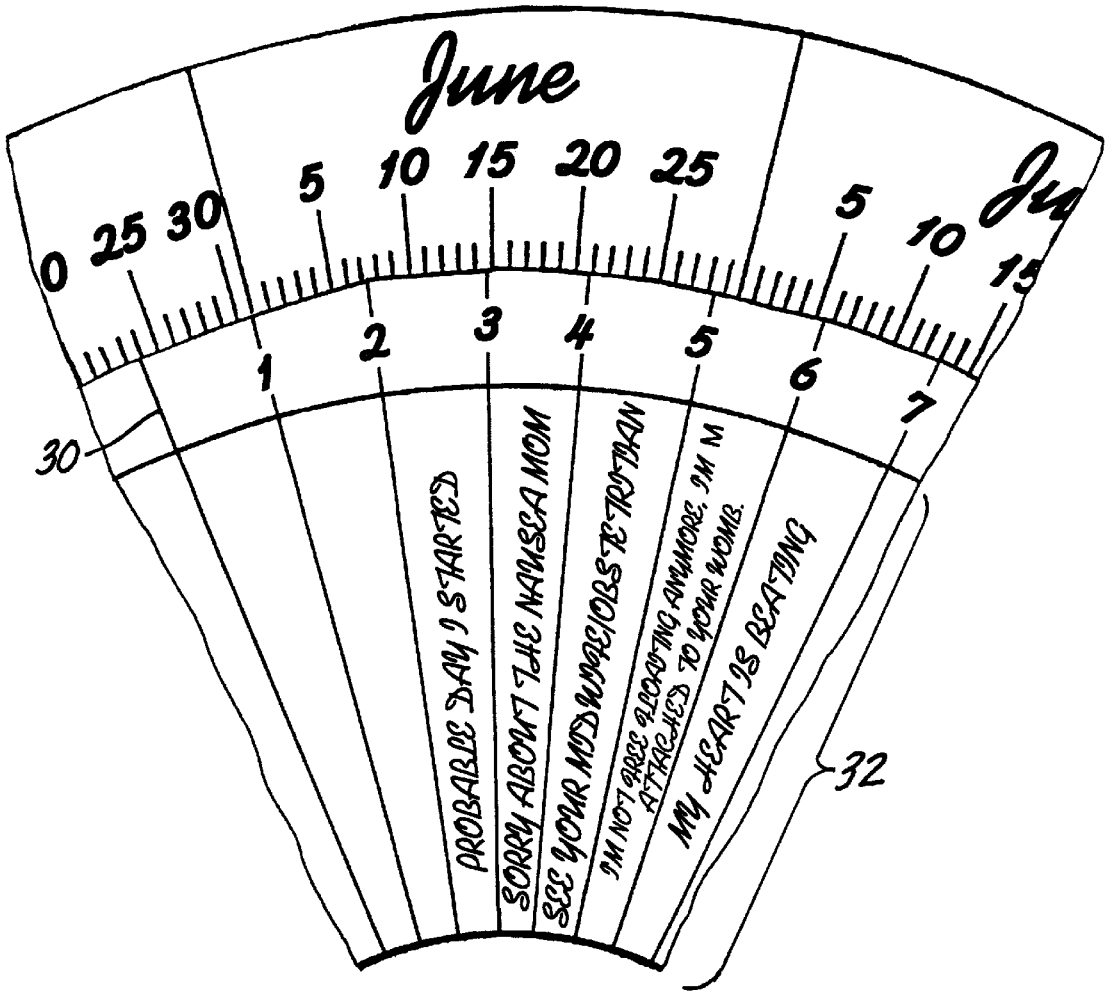
FIG. 2 is an enlarged view of a first portion of the calendar of FIG. 1.
Figure 3:
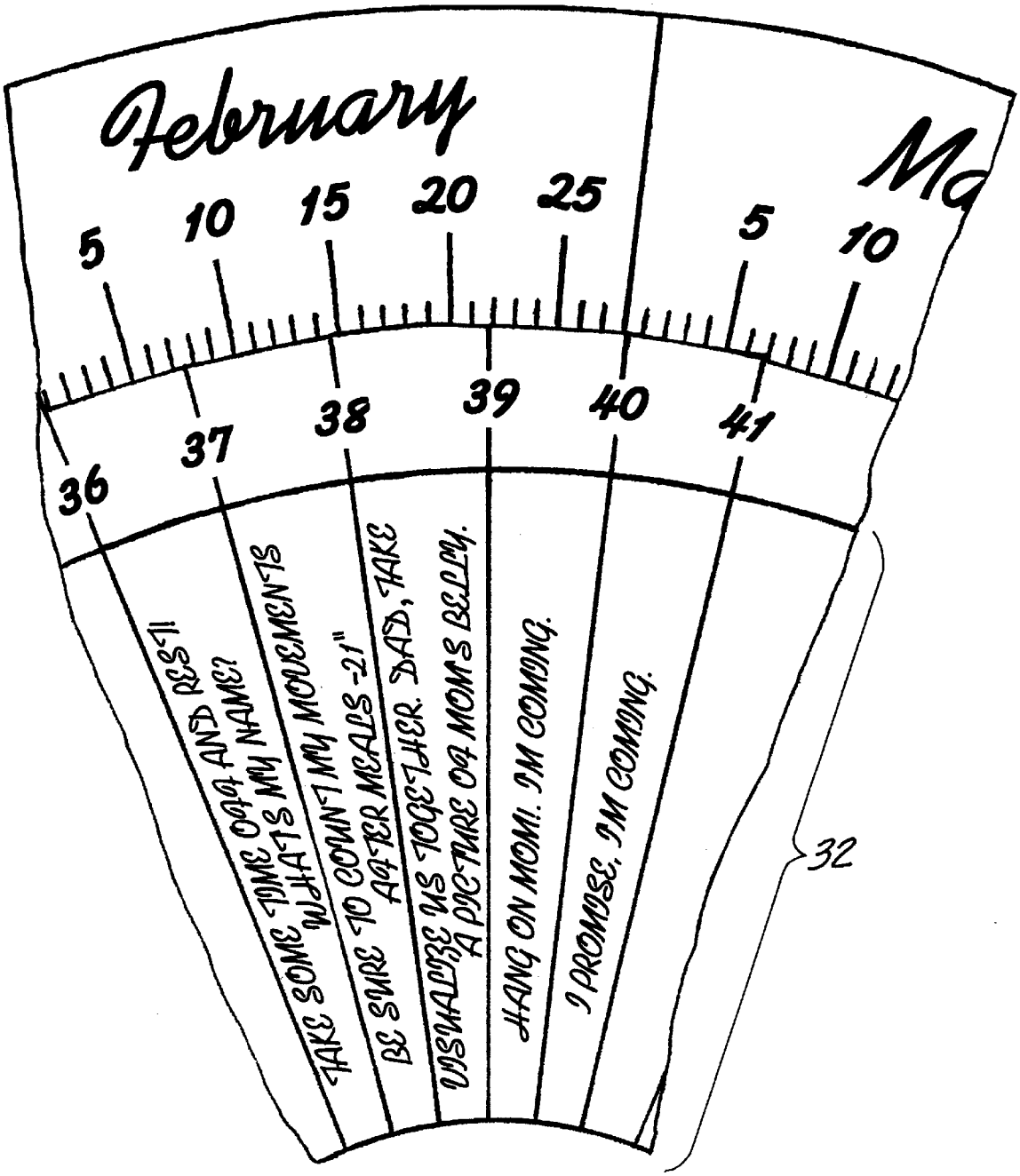
FIG. 3 is an enlarged view of a second portion of the calendar of FIG. 1.

FIG. 2 is an enlarged view of the calendar in FIG. 1 which corresponds to the beginning of the term of gestation. Thus, the imagined statements begin within the third week following the start date (May 24) of the mother's last period with, "Probable day I started." FIG. 3 is an enlarged view of that portion of the calendar 10 in FIG. 1 that corresponds to the end of the gestation term. The statement within the sector 32 corresponding to the forty-first week reads, "I promise, I'm coming".

The following table sets out examples of statements for each of weeks 3–41 which may appear in the corresponding sectors 32.

| WEEK | STATEMENT |
|---|---|
| 3 | Probable day I started |
| 4 | Sorry about the nausea, mom |
| 5 | See your midwife/obstetrician |
| 6 | I'm not free floating anymore, I'm attached to your womb |
| 7 | My heart is beating |
| 8 | One-half inch long |
| 9 | I have big toes now! |
| 10 | One inch long - Need lots of dairy products |
| 11 | Reproductive organs are forming. What do I do with them? |
| 12 | I'm one or two ounces |
| 13 | Vocal cords are complete. Can we talk? |
| 14 | I'm about 5 inches long! We finished the first trimester! |
| 15 | I can smile and frown |
| 16 | Three ounces, 6 inches. Proud mom? |
| 17 | I can see in here, but only bright light |
| 18 | One-half pound - I like sucking my thumb |
| 19 | Water, water, water. Want to go for a walk Mom? |
| 20 | Was I cute in the ultra-sound picture? |
| 21 | That was a somersault mom |
| 22 | I'm about one pound! I love you! |
| 23 | Dad, listen to my heartbeat through mom's tummy. |
| 24 | I'm 12 inches tall! Don't forget to take your prenatal vitamins. |
| 25 | Think about childbirth classes |
| 26 | I'm just under 2 pounds, Mom you're beautiful! |
| 27 | Starting the third trimester |
| 28 | Careful, please no premature labor |
| 29 | I move to the beat of music; is that disco? |
| 30 | I'm about 2 ½ to 3 pounds, and 15 inches long |
| 31 | Let's take a nap mom! |
| 32 | That's my toes in your rib cage |
| 33 | I'm getting lots of protective antibodies from you. Thanks. |
| 34 | Make a birth plan if you like and pick a pediatrician for me! |
| 35 | Four pounds or more- 17 inches. Whoa. I'm really gaining weight, getting tight in here |
| 36 | About 5 pounds, 5 ounces - sorry about pressing on your bladder |
| 37 | Take some time off and rest! What's my name? |
| 38 | Be sure to count my movements after meals - 21 inches |
| 39 | Visualize us together. Dad take a picture of Mom's belly! |
| 40 | Hang on mom, I'm coming |
| 41 | I promise, I'm coming |

A number of the statements relate to prenatal health care measures to be taken by the mother at certain times during the gestation term. See e.g., the statements for weeks 5, 6, 25, 31, 33, 34 and 37.

In use, the second board 22 is positioned to align its index mark 30 with a start date of the expectant mother's last period in the first indicia 14 on the first board 12. The state of the fetus at a certain date during pregnancy along with any corresponding prenatal health steps for the mother, are conveyed by the text within that sector 32 which is aligned with the certain date in the first indicia 14. For example, in the illustrated embodiment, during the fifth week of gestation the mother is instructed to see her obstetrician of midwife.

Figure 4:
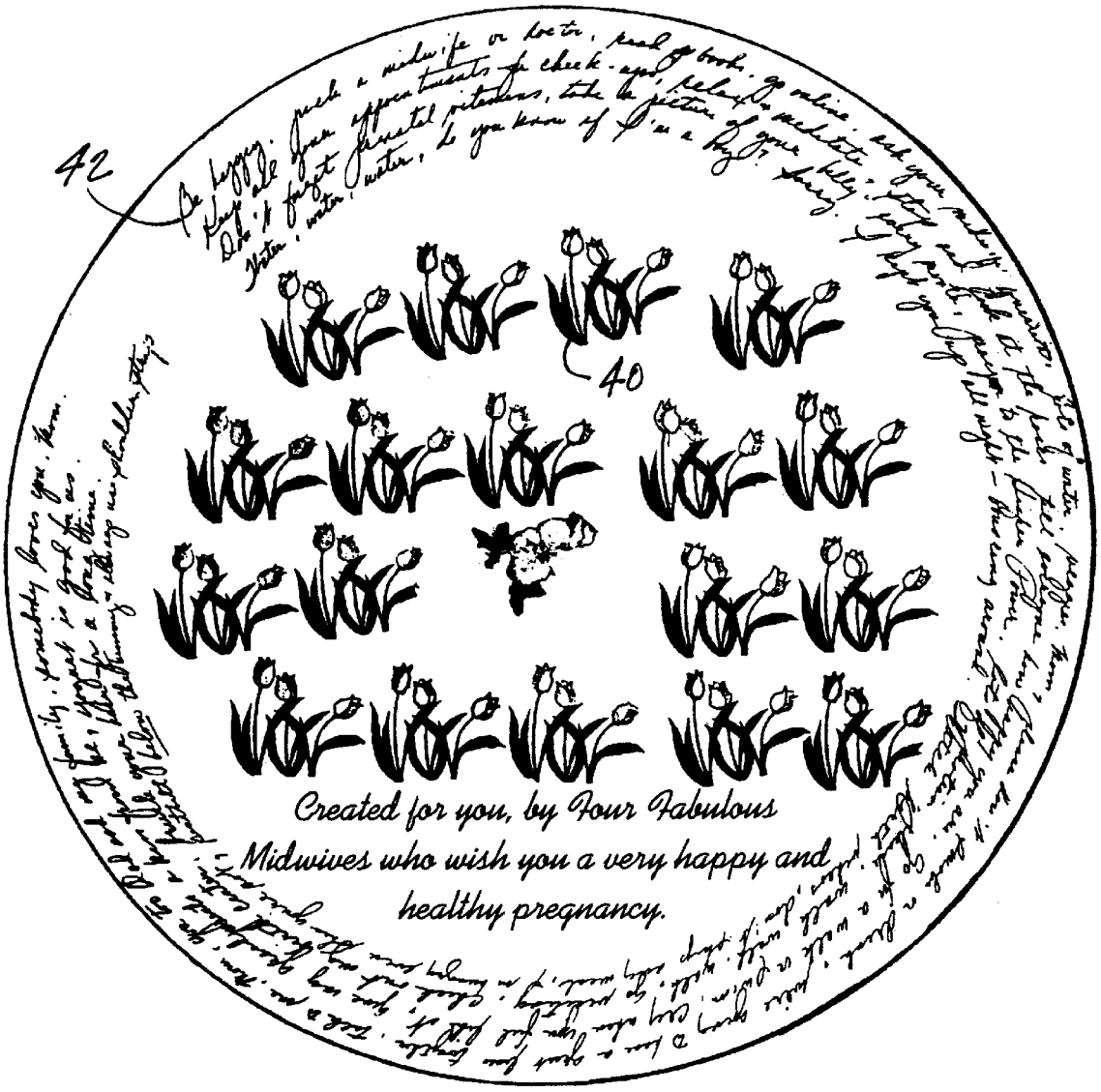
FIG. 4 is a view of the calender of FIG. 1 as seen from the rear.

FIG. 4 shows the rear side of the first board 12. In addition to having decorative indicia 40, various messages 42 on the rear side may be provided concerning the mother's overall physical and mental health during pregnancy. For example, "Stop and look at the roses—Tell everyone how happy you are—Cry when you feel like it—Yogurt is good for us—Watch birth videos—Don't skip any meals—I'm hungry even when you're not—Seat belt below the tummy and always use shoulder strap."

While the foregoing description represents a preferred embodiment of the invention, it will be obvious to those skilled in the art that various changes and modifications may be made without departing from the spirit and scope of the invention pointed out by the following claims.

We claim:

1. A gestation calendar for use by an expectant mother, comprising:

a first sheet material in the form of a circular first disk having first indicia printed circumferentially on a front side of the disk to define dates of a calendar year;

a second sheet material in the form of a circular second disk that is pivoted concentrically to the first disk for relative rotational movement, and the second disk has an index mark and second indicia defining a number of sectors of substantially equal areas corresponding to time intervals of a gestation term;

wherein the areas of the sectors defined by the second indicia contain imagined statements from the fetus representing its development at time intervals represented by the sectors from conception to birth, and a number of the statements convey important information concerning prenatal health care for the mother including at least one or more of (I) consulting with a midwife or obstetrician, (ii) consulting with a pediatrician, (iii) undergoing an ultrasound examination, (iv) a need for water, and (v) a need for rest;

so that when the second disk is positioned to align the index mark on the second disk with a start date of the expectant mothers last period in the first indicia on the first disk, an imagined statement of the fetus at a given date during the gestation term including prenatal health care information conveyed by the statement, is contained within the area of the sector on the second disk which is aligned with the given date in said first indicia.

2. A gestation calendar according to claim 1, wherein the first indicia on the first disk includes month-sectors that define each month of the year.

3. A gestation calendar according to claim 2, wherein the first indicia includes scale marks that define each day within each of the month-sectors.

4. A gestation calendar according to claim 1, wherein the time intervals defined by the second indicia on the front side of the second disk correspond to successive weeks of the gestation term.

5. A gestation calendar according to claim 1, wherein a back side of the first disk has third indicia including messages concerning the mother's overall physical and mental health during pregnancy.

* * * * *